US008368305B2

(12) United States Patent
Zhokhavets et al.

(10) Patent No.: US 8,368,305 B2
(45) Date of Patent: Feb. 5, 2013

(54) ROTATING WHEEL ELECTRODE DEVICE FOR GAS DISCHARGE SOURCES COMPRISING WHEEL COVER FOR HIGH POWER OPERATION

(75) Inventors: Vladzimir Zhokhavets, Aachen (DE); Thomas Kruecken, Aachen (DE); Guenther Hans Derra, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 514 days.

(21) Appl. No.: 12/674,921

(22) PCT Filed: Aug. 14, 2008

(86) PCT No.: PCT/IB2008/053262

§ 371 (c)(1),
(2), (4) Date: Feb. 24, 2010

(87) PCT Pub. No.: WO2009/031059

PCT Pub. Date: Mar. 12, 2009

(65) Prior Publication Data

US 2011/0133621 A1 Jun. 9, 2011

(30) Foreign Application Priority Data

Sep. 7, 2007 (EP) ..... 07115919

(51) Int. Cl.
*H01J 17/28* (2006.01)

(52) U.S. Cl. ..... 313/631; 250/504 R

(58) Field of Classification Search ..... 313/326, 313/631, 231.71; 378/121; 250/504 R
See application file for complete search history.

(56) References Cited

U.S. PATENT DOCUMENTS

| | | | | |
|---|---|---|---|---|
| 6,946,669 | B2 * | 9/2005 | Kleinschmidt | 250/504 R |
| 7,427,766 | B2 * | 9/2008 | Jonkers et al. | 250/504 R |
| 7,897,948 | B2 * | 3/2011 | Jonkers et al. | 250/504 R |
| 8,040,033 | B2 * | 10/2011 | Zhokhavets et al. | 313/326 |
| 8,253,123 | B2 * | 8/2012 | Jonkers et al. | 313/326 |
| 2004/0155207 | A1 * | 8/2004 | Kleinschmidt | 250/504 R |
| 2009/0250638 | A1 * | 10/2009 | Jonkers et al. | 250/493.1 |
| 2011/0133641 | A1 * | 6/2011 | Zhokhavets et al. | 313/631 |
| 2011/0248192 | A1 * | 10/2011 | Jonkers et al. | 250/504 R |

FOREIGN PATENT DOCUMENTS

| | | | |
|---|---|---|---|
| WO | 2005025280 | A2 | 3/2005 |
| WO | 2006123270 | A2 | 11/2006 |

* cited by examiner

*Primary Examiner* — Nimeshkumar Patel
*Assistant Examiner* — Christopher Raabe
(74) *Attorney, Agent, or Firm* — Mark L. Beloborodov

(57) ABSTRACT

The present invention relates to an electrode device (1, 2) for gas discharge sources and to a gas discharge source having one or two of said electrode devices (1, 2). With the proposed design of the cover (8), an efficient cooling of the electrode wheel (7) is achieved, allowing high electrical powers for operating gas discharge sources with such an electrode device.

15 Claims, 3 Drawing Sheets

ROTATING WHEEL ELECTRODE DEVICE FOR GAS DISCHARGE SOURCES COMPRISING WHEEL COVER FOR HIGH POWER OPERATION

FIELD OF THE INVENTION

The present invention relates to an electrode device for gas discharge sources comprising at least one electrode wheel rotatable around a rotational axis, said electrode wheel having an outer circumferential surface between two side surfaces. The invention further relates to a gas discharge source comprising such an electrode device and to a method of operating the gas discharge source with this electrode device.

BACKGROUND OF THE INVENTION

Gas discharge sources are used, for example, as light sources for EUV radiation (EUV: extreme ultra violet) or soft x-rays. Radiation sources emitting EUV radiation and/or soft x-rays are in particular required in the field of EUV lithography. The radiation is emitted from hot plasma produced by a pulsed current. Known powerful EUV radiation sources are operated with metal vapor to generate the required plasma. An example of such a EUV radiation source is shown in WO 2006/123270 A2. In this known radiation source the metal vapor is produced from a metal melt which is applied to a surface in the discharge space and at least partially evaporated by an energy beam, in particular by a laser beam. To this end, two electrodes are rotatable mounted forming electrode wheels which are rotated during operation of the radiation source. The metal melt is applied to the circumferential surface of each electrode wheel via a connecting element which is arranged between a reservoir containing the metal melt and the electrode wheel. The connecting element is designed to form a gap between the outer circumferential surface and the electrode wheel over a partial section of the circular periphery of the electrode wheel. During rotation of the electrode wheel the metal melt penetrates from the reservoir into the gap, thereby forming the desired thin film of liquid metal on the outer circumferential surface of the electrode. A pulsed laser beam is directed to the surface of one of the electrodes in the discharge region in order to evaporate part of the metal melt producing metal vapor and to ignite the electrical discharge. The metal vapor is heated by a current of some kA up to some 10 kA so that the desired ionization stages are excited and light of the desired wavelength is emitted. The liquid metal film formed on the outer circumferential surfaces of the electrode wheels fulfils several functions. This liquid metal film serves as the radiating medium in the discharge and protects as a regenerative film the wheel from erosion. The liquid metal film also electrically connects the electrode wheels with a power supply which is connected to the electrically conductive connecting element. Furthermore, the liquid metal dissipates the heat introduced into the electrodes by the gas discharge.

For high power operation of such a gas discharge source or lamp which is required for future high volume manufacturing (HVM) of semiconductor devices, high electrical input powers must be applied. In order to guarantee a required wafer throughput of approximately 100 wafers/h, a high volume manufacturing EUV source must be operated at input electrical powers of 50 kW or more. About 50% of this input power is absorbed by the rotating electrodes. With the above described known gas discharge source, the heat dissipation from electrode wheels is not sufficiently high which results in overheating of the electrodes at higher powers. For this reason the known gas discharge source can not be operated at electrical input powers required for a high volume manufacturing EUV source.

SUMMARY OF THE INVENTION

It is an object of the present invention to provide an electrode device for use in a gas discharge source and a corresponding gas discharge source, which allow the operation of the gas discharge source with a high input power without overheating the electrode wheels.

The object is achieved with the electrode device and the gas discharge source according to claims 1 and 15. Advantageous embodiments of the electrode device and gas discharge source are subject matter of the dependent claims or are disclosed in the subsequent portion of the description. Claim 16 refers to a preferred method of operating such a gas discharge source.

The proposed electrode device at least comprises an electrode wheel rotatable around a rotational axis, said electrode wheel having an outer circumferential surface between two side surfaces, and an electrode wheel cover covering a partial section of said outer circumferential surface and said side surfaces in a circumferential direction. The proposed cover is designed to form a cooling channel in said circumferential direction between the cover, the outer circumferential surface and a radially outer part of the side surfaces for cooling the electrode wheel by liquid material, in particular a metal melt. The cover comprises an inlet and an outlet opening for the cooling channel to allow the flow of the liquid material through the cooling channel. In one alternative the cover is further designed to form a gap between the cover and the outer circumferential surface and part of the side surfaces in extension of the cooling channel in the circumferential direction, said gap limiting the thickness of the liquid material film formed on the outer circumferential surface and the side surfaces during rotation of the electrode wheel. In another alternative the cover is further designed to inhibit the formation of such a film from the liquid material flowing through the cooling channel in extension of said cooling channel in the circumferential direction. Preferably, the outlet opening is arranged between the cooling channel and the gap to drain off excess liquid material at the transition between the cooling channel and the gap which has a significantly smaller flow cross section for the liquid material than the cooling channel.

With the proposed electrode device two modes of operation may be realized depending on the design of the cover. In a first mode the applied liquid material used as fuel for the gas discharge in a gas discharge source with such an electrode device more efficiently cools the heated electrode wheel. The cooling channel is designed such that the outer portion of the electrode wheel including the outer circumferential surface and the radially outer portions of the side surfaces are surrounded by a sufficient amount of liquid material for heat dissipation into this liquid material. The cooling channel—in the rotational direction—merges into a small gap channel between the wheel cover and the outer circumferential surface and the side surfaces of the electrode wheel to limit the thickness of the liquid material film at the outer circumferential surface and the side surfaces of the rotating electrode wheel. Preferably at least one wiper unit is arranged behind and/or before the gap channel in the rotational direction in order to additionally restrict the liquid material film to the thickness and shape required for evaporation at the discharge location without the risk of droplet formation due to centrifugal forces acting on this liquid material film.

In a second mode the thickness of the film is limited to a smallest possible thickness or the formation of the film is completely inhibited by the design of the cover. The cooling channel is also designed such that the outer portion of the electrode wheel including the outer circumferential surface and the radially outer portions of the side surfaces are surrounded by a sufficient amount of liquid material for heat dissipation into this liquid material. This mode of operation requires a separate liquid material application unit to apply the liquid material used as fuel for the gas discharge. This application or injection unit is arranged to apply said liquid material on the outer circumferential surface of the electrode wheel between said cover and the location of gas discharge generation and must provide sufficient liquid material coverage to protect the rotating electrode from erosion due to the discharge. One or several nozzles can be used for example.

This second mode of operation allows fine tuning of the thickness of the liquid film and/or the amount of liquid film material at the discharge location. Since the liquid material application or injection unit is separated from the cooling channel, it is much easier to control the liquid material coverage on the electrode wheel at the discharge location compared to the former mode of operation. For instance, the liquid material film thickness can be adjusted in the range of several micrometers to several hundreds of micrometers by varying the liquid material flow through the application unit. The liquid material electrode coverage can be optimized by laterally limiting the thin film to a position where the electrode must be protected, whereas the remaining parts of the electrode may stay uncovered. Further reduction of the amount of liquid material on the electrode can be achieved by intermittently delivering the liquid material, using for example a droplet generator, such that separated islands or regions of this material form on the electrode. These measures allow to minimize the amount of liquid material on the electrode and thus to obtain the highest possible electrode circumferential velocity. The amount of debris produced by discharge is minimized, too.

For the second mode of operation the cover preferably comprises a wiper unit to achieve the limitation of the thickness of the thin film to the smallest possible thickness or the inhibition of the formation of such a film. An ideal wiper should prevent the liquid material leakage from the cooling channel. In practice the residual liquid material film thickness after passing through the wiper unit should not exceed 5 micrometers. This can be achieved for example by using a shaped part that exactly reproduces the form of the electrode. This part can be held in contact with the electrode by elastic element(s). In this case the liquid material acts as lubricating medium between the shaped part and the electrode, thus preventing erosion of wiper and/or rotating electrode. This effect, however, might depend on the circumferential speed of the electrode wheel. A failure of this dynamic lubrication could lead to enhanced erosion of wheel and wiper, an uncontrolled liquid material film, or even a blocking of the rotating electrode. Therefore the wiper preferably is formed of a self-lubricating material or coated with such a material suitable for dry-running operation. Moreover it must be thermally stable and chemically resistant to the liquid material. A material like graphite fulfils these requirements.

To obtain highest possible electrode circumferential velocities in the second mode of operation, the liquid material application or injection system should be placed as close as possible to the discharge location. The liquid material amount on the rotating electrode should be minimized, i.e. the amount deposited, expressed as volume flux $\dot{V}$, is preferably chosen to be smaller than $2\sigma/\rho\omega$, i.e. $\dot{V}<2\sigma/\rho\omega$, where $\omega$ denotes the wheels angular velocity and $\rho$ and $\sigma$ density and surface tension of the liquid material. To avoid liquid material film instabilities, the electrode width D should be in the range of $D^*<D<10\cdot D^*$, with $D^*=\pi\sqrt{\sigma/(\rho\omega^2 R)}$, R denoting the radius of the electrode wheel.

Due to the higher efficiency of cooling of the electrode wheel with the proposed wheel cover design, a gas discharge source with such an electrode device can be operated at high electrical powers in the range of tens of kW and higher without overheating the electrodes. This allows operation of the gas discharge source as a high volume manufacturing EUV source when using the appropriate liquid material, in particular a metal melt like liquid tin.

The proposed design of the electrode wheel cover also allows increasing the rotational speed of the electrode wheels as is explained in the following. A high input power requires a high discharge repetition rate of 10 kHz or more. For a stable light output, in particular an output of EUV radiation, of the gas discharge source or lamp it is required, that consecutive discharge pulses are hitting always a fresh smooth portion of the rotating electrode surfaces. The distance of consecutive discharge pulses on the moving electrode surface has to be in the order of a few tens of a millimeter up to a few millimeters. Therefore, the electrode rotational speed must be increased accordingly, resulting in the required circumferential velocities in the order of approximately 10 m/s. In practice, such high circumferential velocities of the electrode wheels may cause liquid material surface waves and therefore an unstable liquid material film at the discharge location. This leads to unstable EUV output and, in the worst case, to lamp failure due to liquid material spread and droplet formation. This problem is avoided with the electrode wheel cover designed according to the present invention. With the wheel cover, the free liquid material surface on the electrode wheel is minimized. By this measure, disturbing liquid material surface waves and the formation of droplets are prevented. The liquid material flow in the cooling channel and in the covered part of the wheel forming the gap channel becomes more stable, which results in better liquid material film stability at the discharge location.

In a preferred embodiment, the outlet opening of the cooling channel of the wheel cover is connected via a feed line and a cooling device to the inlet opening to form a cooling circuit, wherein the cooling device, which may be a heat exchanger, is dimensioned to cool said liquid material supplied to the inlet opening of the cover. In a further improvement of this embodiment, a pump is arranged in said cooling circuit which actively circulates the liquid material in the cooling circuit. Without the provision of such a pump, the pumping effect of the rotating wheel itself can be used to achieve a sufficient circulation or flow of the liquid material through the cooling channel. Nevertheless, by actively driving the liquid material by a pump, an improved and more reliable cooling is achieved. In particular, the pump power can be adjusted to exactly apply the amount of liquid material per time which is required for optimal cooling and discharge generation.

The gap channel formed in extension of the cooling channel is preferably dimensioned such that the width of the gap does not exceed the width of the outer circumferential surface of the electrode wheel. In one of the embodiments this gap channel extends over a circumferential length which is at least a quarter of the length of the cooling channel. The whole cover preferably extents in the circumferential direction over a main circumferential portion of the electrode wheel, covering a main circumferential portion of the circumferential surface. Main portion means that more than half of the circumferential length of the electrode wheel is covered. Preferably, more than 3 quarters of the circumferential length of the electrode wheel are covered by the electrode wheel cover.

To prevent leakage of liquid material from the wheel cover, in the parts not lying within the cooling channel region, the cover should reproduce the wheel form with the smallest possible distance to the outer circumferential surface and the side surfaces of the wheel. It has been found experimentally, that the gap between the outer circumferential surface of the wheel and the wheel cover should not exceed 0.5 mm in the covered part, i.e. in the gap channel. Preferably, the gap height should be several ten up to 100 micrometers. To avoid liquid material leakage, in addition non wetting materials or coatings may be applied to the side surfaces of the wheel and the inner surfaces of the cover.

For the first mode of operation the wheel cover may comprise a pair of wipers removing all liquid material from the rather large side surfaces accompanied by a solid wiper at a controlled distance h to the outer wheel surface. To avoid liquid material droplets from the rotating electrode, the condition $h<2\sigma/(\rho\omega^2 R D)$ must be satisfied, where $\omega$ denotes the wheels angular velocity, R and D the radius and width of the electrode and $\rho$ and $\sigma$ the density and surface tension of the liquid material. The excess liquid material from the outer surface must be removed by the solid wiper in such a way that no liquid metal can evade back to the wheel's sides.

To maximize the cooling efficiency, the liquid material inlet of the cover should be placed as close as possible to the discharge location. The cooling effect is larger if the cold liquid material supplied to the cooling channel through the inlet opening hits the hot part of the wheel as close as possible to the discharge location. This is achieved if the cooling flow is directed along the wheel rotation, i.e. in the rotational direction, through the cooling channel. Also the pressure gradient in the cooling channel is lower for liquid material flow in the direction of the wheel rotation, so this realization is preferred over a flow in reverse direction.

The liquid metal throughput should preferentially be adjusted to ensure that the cooling channel is almost completely filled with liquid material. This is achieved with the use of the above described external pump with adjustable pump power. To reduce local liquid material pressure maxima and associated liquid material leakage, kinks should be avoided in the design of the cooling channel. In a preferred design, inlet and outlet openings of the cooling channel are directed nearly tangential to the wheel periphery.

Preferably, for the first mode of operation a wiper unit is arranged at the outlet of the gap channel formed between the cover and the outer circumferential surface. This wiper unit, also called final wiper in this patent description, is designed to further limit the thickness of the liquid material film on the outer circumferential surface during rotation of the electrode wheel in such a manner that the desired film thickness and shape is achieved at the discharge location. This desired film thickness and shape is selected to achieve an optimum evaporation and discharge generation at the discharge location.

Preferably the final wiper, which may be formed of one single wiper element or of several wiper elements acting together, is designed to inhibit or at least reduce a migration of liquid material from the side surfaces to the circumferential surface during rotation of the electrode wheel. This may be achieved by using a wiper unit, having e.g. a fork-like shape, which strips off liquid material remaining on said side surfaces adjacent to the circumferential surface during rotation of the electrode wheel. In a preferred embodiment in connection with the provision of such a final wiper, an overflow channel is formed in the cover in order to take in the excess liquid material generated by the effect of said final wiper. This overflow channel prevents too high liquid material pressures at the final wiper.

In a further preferred embodiment relating to the first mode of operation a further wiper unit is arranged between the cooling channel and the gap channel, wherein this wiper unit, also called pre-wiper in this patent description, is designed to limit the thickness of the liquid material film on the outer circumferential surface and to strip off liquid material from the side surfaces during rotation of the electrode wheel. This pre-wiper controls the passage of liquid material from the cooling channel into the gap channel formed by the electrode wheel cover.

In order to allow the supply of an electrical current to the electrode wheel, at least a portion of the electrode wheel cover or a wiper unit being part of said cover is made of an electrically conductive material. The high voltage may then be applied to this electrically conductive portion of the electrode wheel cover generating an electrical connection with the electrode wheel through the applied liquid material which is also electrically conductive, preferably a metal melt like liquid tin.

The evolution of the liquid material profile on the uncovered part of the outer circumferential surface of the electrode wheel under centrifugal, viscous and surface tension forces could lead to a release of liquid metal droplets from the wheel after a certain time period T. This time period decreases with increasing rotational speed. Thus, to achieve higher rotational speeds, in the first mode of operation the distance between the final wiper and the cover entrance, i.e. the opposing end of the cover, should be minimized. This means that the final wiper and the cover entrance should be positioned as close as possible to the discharge location. Nevertheless free emission of the radiation emitted by the gas discharge source into a large solid angle must be granted. For this reason, a slim design of the wheel cover near the discharge location is preferred.

At high rotational speed of the electrode wheel, due to the strong centrifugal forces, the side surfaces of the wheel become almost free of liquid material, avoiding liquid material leakage through gaps between the cover and the side surfaces of the wheel in the central region of the wheel. Liquid material removal from the wheel side surfaces can be improved by tilting the pre-wiper and final wiper or any other wiper with respect to the radial direction. Since the side surfaces of the wheel for these reasons are almost free of liquid material, the wheel rotational speed can be increased without risk of unacceptable increase of liquid material film thickness on the wheel outer surface. Another benefit of this concept is that the significant liquid material pressure in the cooling channel can be compensated by the centrifugal force in the central region, allowing high liquid material throughput through the cooling channel without outflow of liquid material in the central region. At the same time, the contact area between liquid material and the wheel can be increased in comparison to the previous state of the art design of the electrode device. This results in much better cooling of the electrode wheel.

If the rotational speed of the wheel is set high enough, the centrifugal forces exceed the gravitational ones. Thus the operation performance of the wheel cover becomes independent of the gravity. As a criterion, the centrifugal acceleration given as $\omega w^2 \cdot R$ ($\omega$=angular frequency, R=wheel radius) should be larger than the gravitational acceleration $g=9.81\ m/s^2$. In particular, arbitrary orientation and even horizontal position of the wheel can be realized in this way.

These and other aspects of the invention will be apparent from and elucidated with reference to the embodiments described hereinafter.

BRIEF DESCRIPTION OF THE DRAWINGS

The proposed electrode device and gas discharge source are described in the following by way of examples in connection with the accompanying figures without limiting the scope of protection as defined by the claims. The figure show:

DESCRIPTION OF PREFERRED EMBODIMENTS

Figure 1:
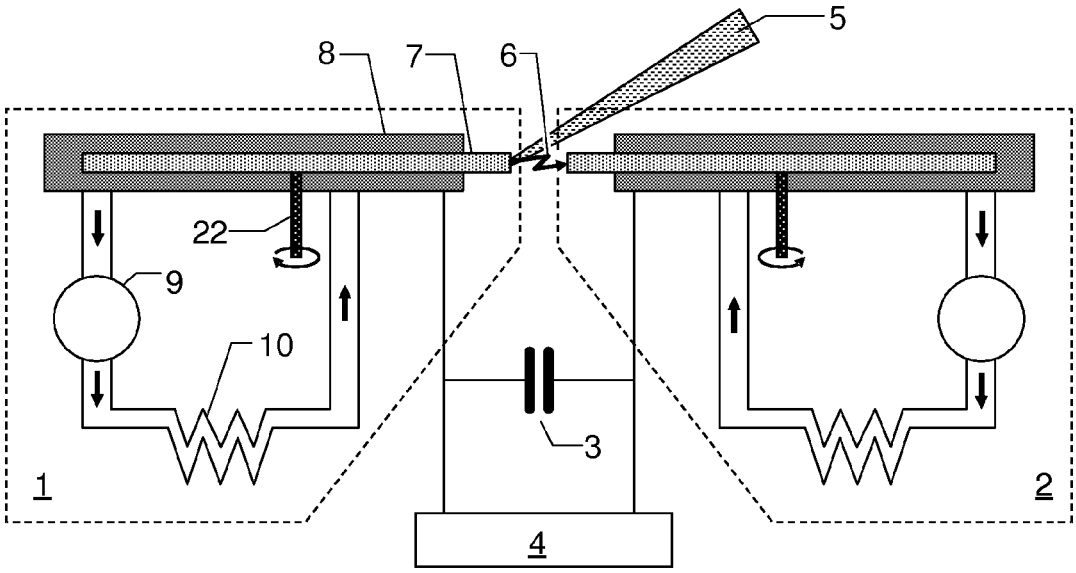
FIG. 1 a schematic view of a gas discharge source with an electrode device according to a first embodiment of the present invention.

FIG. 1 shows a schematic view of an exemplary gas discharge source with two electrode devices 1, 2 according to the present invention. The electrode devices 1, 2 are characterized by a specially designed encapsulation or cover 8 of the rotating electrode wheels 7 and a forced flow of liquid metal used in this gas discharge source for generation of a gas discharge.

The improved gas discharge source consists of the two rotating electrode devices 1, 2, which are connected to a capacitor bank 3 charged by a power supply 4. During operation of the gas discharge source, liquid metal is applied to the outer circumferential surface of the electrode wheels 7 to form a thin liquid metal film on this surface at the discharge location 6. An energy beam 5, for example a laser beam, is directed to the outer circumferential surface of one of the rotating electrode wheels 7 to evaporate part of the liquid metal at the discharge location 6 and to induce an electrical discharge between the electrode devices 1, 2. When applying an appropriate metal melt like liquid tin as the liquid metal on the electrode wheels 7, the discharge generates EUV radiation, i.e. the gas discharge source according to FIG. 1 acts as a EUV lamp.

Each of the electrode devices 1, 2 consists of an electrode wheel 7 rotating about a rotational axis 22 and encapsulated by a cover construction, i.e. the wheel cover 8, a liquid metal pump 9 and a cooling device 10. The design of the wheel cover 8 is an essential part of the proposed electrode device and gas discharge. The main features of this wheel cover 8 are explained in the following with reference to FIG. 2.

Figure 2:
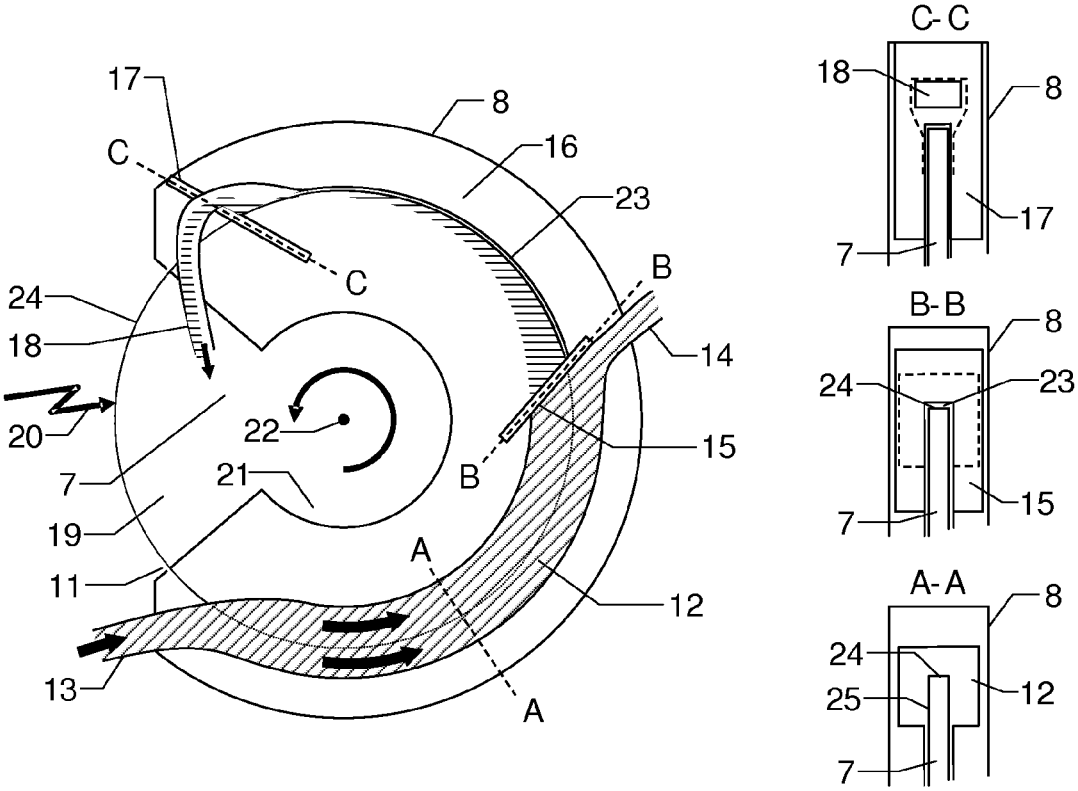
FIG. 2 a cross sectional view of a first example of an electrode device according to the present invention.

FIG. 2 shows a cross sectional view of electrode wheel 7 covered by the wheel cover 8. The rotational direction is indicated with the curved arrow at the central region 21 of the electrode wheel 7. The electrode wheel cover 8, which encapsulates electrode wheel 7 over a main portion of its circumferential periphery, comprises two sections. In a first section a cooling channel 12 is formed between the outer circumferential surface 24 of the electrode wheel 7, radially outer portions of the side surfaces 25 and the wheel cover 8. In the second section, also called covered part 16, in extension of the cooling channel 12 the cover 8 follows the wheel form with a small distance to the outer circumferential surface 24 to form a small gap 23 between outer circumferential surface 24 and the wheel covered part 16.

At the transition between the cooling channel and this small gap 23 a pre-wiper 15 is placed to limit the film thickness of the liquid metal on the outer circumferential surface 24 of the wheel 7 and to strip off at least part of the liquid metal from the side surfaces 25. An outlet 14 of the cooling channel 12 is arranged at this end of the cooling channel 12. The inlet 13 for liquid material into the cooling channel 12 is arranged close to the wheel cover entrance 11 as can be seen from FIG. 2.

A final wiper 17 is arranged at the open end of gap 23 further limiting and shaping the liquid metal film on the outer circumferential surface 24 of the electrode wheel 7. At the position of this final wiper 17 a so called over flow channel 18 is formed in the wheel cover 8 to drain excess liquid material at this location. In front of the final wiper 17, the cover 8, 16 is fabricated such that the gap channel 23 becomes wider to allow for an essentially unrestricted flow of excess liquid metal into the overflow channel 18.

A region 19 of the electrode wheel is uncovered to allow for the pulsed evaporation of the liquid metal film, the formation of the discharge at the discharge location 20 and enable free radiation of the EUV light.

FIG. 2 also shows enlarged cross sectional views along the line A-A of the cooling channel 12, along the line B-B of the gap 23 including pre-wiper 15 and along line C-C at the final wiper location. As is evident from these enlarged cross sectional views, the cross section of the gap 23 formed between the electrode wheel cover 8 and the outer circumferential surface 24 of the electrode wheel 7 in extension of the cooling channel 12 is significantly smaller than the cross section of the cooling channel 12. In the enlarged cross sectional view along C-C also overflow channel 18 can be recognized.

The cooling channel 12 of wheel cover 8, the liquid metal pump 9 and the cooler 10 form a loop to allow for a circulating liquid metal flow as shown in FIG. 1. In this loop a continuous heat transfer is achieved from the rotating electrode wheel 7 via the liquid metal pump 9 to the cooling device 10. Compared to state of the art concepts using liquid metal baths in which the electrode wheels dip, the geometry of the cooling device is not restricted to any bath dimensions and therefore can be arbitrarily chosen to ensure an effective heat transfer even for very high dissipating power. Because the flow of liquid metal is forced by the pump 9, the flow velocity of cool liquid metal along the wheel surface can be very much increased compared to the state of art, where only the wheel velocity is effective. This results in a much higher heat transport, a much more effective cooling and lower average wheel temperature.

The working principle of the wheel cover 8 is described in the following. Starting from the discharge region 6, 20, where the electrode wheel 7 is heated by the electrical discharge, the hot wheel passes through the wheel cover entrance 11 into the cooling channel 12, which is cooled by the liquid metal flow. The liquid metal flow is driven by the pump 9 and is injected into the cooling channel 12 by a liquid metal inlet 13. The flow of liquid metal is indicated by the arrows. As can clearly be recognized in the enlarged cross sectional view along line A-A in FIG. 2, the cooling channel 12 allows the cooling of the outer circumferential surface 24 of the electrode wheel 7 and of outer portions of the side surfaces 25 which are enclosed by the liquid metal. To increase the cooling efficiency, the flow velocity of the liquid metal is preferably higher than the circumferential velocity of the electrode wheel 7. After passing the cooling channel 12, most of the liquid metal is removed from the wheel surface by pre-wiper 15. This fraction of the liquid metal is leaving the cooling channel 12 at the outlet 14, the main liquid metal flow is directed to the external heat exchanger (cooling device 10) and only a small fraction of the liquid metal stays on the wheel surface and enters the gap region 23 of the covered part 16. To avoid pressure built-up the transition where the cooling channel leaves the outer circumferential surface 24 and radially outer parts of side surfaces 25 towards the outlet 14 of the cover must be designed such that no stagnation points can occur. The covered part 16 prevents the release of liquid metal droplets from the wheel during the travel of the liquid metal film remaining on the outer circumferential surface 24 to the final wiper 17. The final wiper 17 forms the liquid metal film on the outer circumferential surface 24 of the wheel 7 to ensure the required film thickness at the discharge location 20. The excess liquid material is removed through the overflow channel 18 to prevent too high liquid metal pressures in front of the final wiper 17. This allows for controlling the liquid metal amount on the outer circumferential wheel surface after the final wiper 17. To minimize kinetic pressures the overflow channel 18 should be designed or attached in a way that avoids rapid changes of the flow direction. In FIG. 2 this is realized such that the gap channel 23 becomes wider in front of wiper 17 to allow for an essentially unrestricted flow of excess liquid metal into the overflow channel 18.

The overflow channel 18 can be connected to an additional port within the cooling loop to reuse the overflow liquid material and to prevent liquid material losses in the cooling circuit. In the uncovered part 19 of the electrode wheel 7 liquid metal remains on the wheel surface due to adhesion forces and surface tension. After passing the discharge region 20, the wheel is again entering the cooling channel 12, where it is cooled and the liquid metal film on the wheel surface is regenerated. It is clear from the above description, that the electrode wheel 7 rotates within the electrode wheel cover 8 which is mounted stationary.

In the above figures, no additional reservoir for the liquid metal is depicted, but depending on the total amount of the liquid material inside of the cooling circuit, such a reservoir may be used in the cooling loop in order to ensure a sufficiently long continuous operation of the discharge source. Furthermore, it goes without saying, that the material of the wheel cover 8 and wipers 15, 17 must be structurally stable and chemically resistant to the liquid metal. To enable electrical contact to the electrode wheel 7, at least one part of the wheel cover 8 must be electrically conductive.

Figure 3:
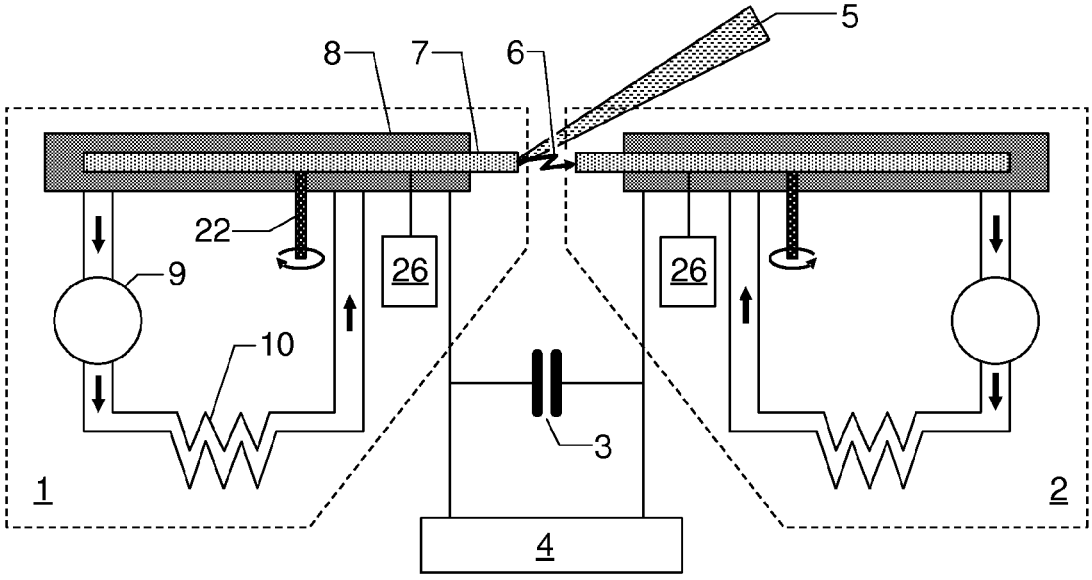
FIG. 3 a schematic view of a gas discharge source with an electrode device according to a further embodiment of the present invention.

FIG. 3 shows a schematic view of a further embodiment of a gas discharge source with two electrode devices 1, 2 according to the present invention. The gas discharge source comprises the two rotating electrode devices 1, 2, connected to a capacitor bank 3, which is charged by a power supply 4. An energy beam 5, e.g. a laser beam, is applied to evaporate some liquid metal from the rotating electrode at the discharge location 6 and to induce the electrical discharge between the electrode devices 1 and 2 and thus to produce the desired EUV radiation.

Each of the rotating electrode devices 1, 2 consists of a rotating electrode wheel 7, encapsulated by a cover construction, called wheel cover 8 in this patent description, a liquid metal pump 9, a cooling device 10 and a liquid metal injection unit 26. The wheel cover 8, the liquid metal pump 9 and the cooler 10 form a closed loop to allow for a circulating liquid metal flow. In this loop, there is a continuous heat transfer from the rotating electrode wheel 7 via the liquid metal pump 9 to the cooler 10. The liquid metal injection unit 26 provides liquid metal material, which may be liquid tin in both cases, on the rotating electrode wheel 7. The liquid metal injection unit 26 may contain a liquid metal reservoir with capacity sufficient to enable required uptime of the EUV source.

Figure 4:
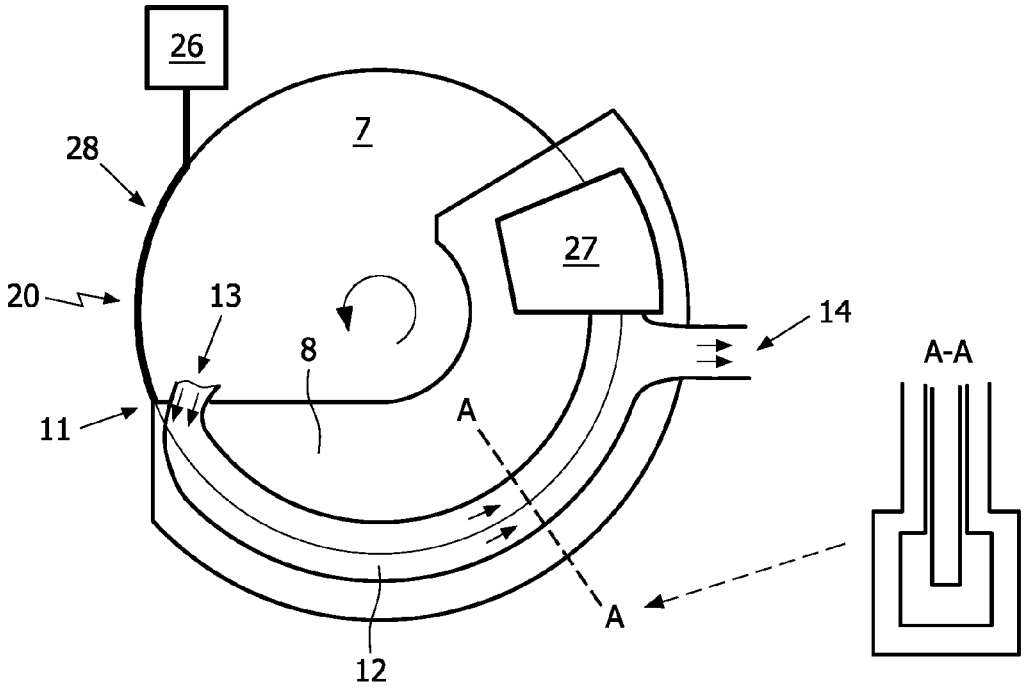
FIG. 4 a cross sectional view of a second example of an electrode device according to the present invention.

The design of the rotating electrode devices 1, 2 is described in the following with reference to FIG. 4, which only shows one of the electrode devices for simplicity. In this embodiment the efficient electrode cooling concept of the embodiment of FIGS. 1 and 2 is combined with a separate liquid metal electrode coating system. The rotating electrode device comprises the following elements:

- wheel cover entrance 11,
- cooling channel 12 with liquid metal inlet 13 and outlet 14,
- wiper 27 placed immediately after the cooling channel 12,
- liquid metal injection unit 26, and
- liquid metal covered part 28 which is exposed to the discharge location 20.

The working principle of this rotating electrode device is described in following. Starting from the discharge location 20, where the electrode wheel 7 is heated by the electrical discharge, the hot wheel passes through the wheel cover entrance 11 into the cooling channel 12, where it is cooled by the liquid metal flow. After passing the cooling channel and leaving it at the outlet 14, the liquid metal flow is directed to the external heat exchanger, i.e. cooling unit 10. The wiper 27 removes the liquid metal from the wheel surface completely. Between the wheel cover 8 and the discharge location 20 the liquid metal injection unit 26 delivers liquid metal to the electrode surface. As a consequence, a continuous thin liquid metal film or liquid metal "islands", corresponding to the locations of the discharge attachments, on the electrode surface in front of the discharge are formed. The liquid metal on the electrode surface is used later as a fuel for the electrical discharge at the discharge location 20.

Figure 5:
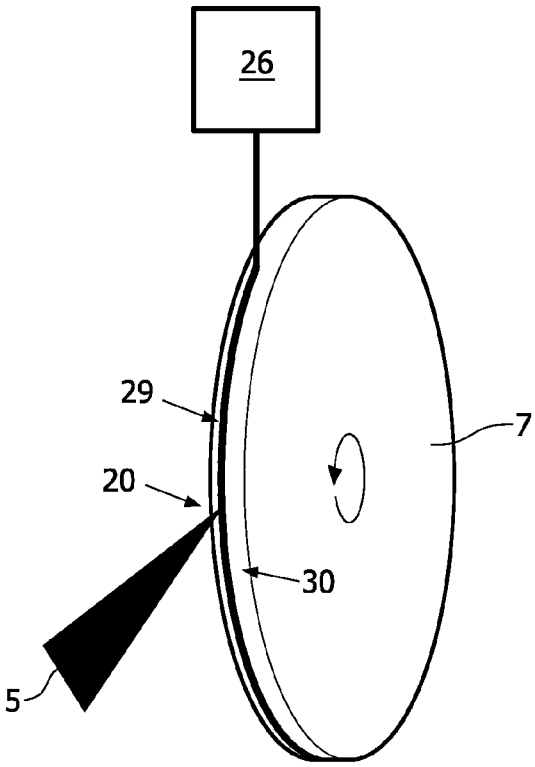
FIG. 5 a schematic view showing a possible mode of application of the liquid material.

Since the liquid metal injection unit 26 is separated from the cooling channel 12, it is much easier to control the liquid metal coverage on the electrode at the discharge location 20 compared to the above first embodiment. For instance, the liquid metal film thickness can be adjusted in the range of several micrometers to several hundreds of micrometers by varying the liquid metal flow. The liquid metal electrode coverage can also be optimized by bringing the liquid metal beading 29 in the position where the electrode must be protected, whereas the remaining parts of the electrode may stay uncovered (uncovered part 30) as is schematically shown in FIG. 5. These measures allow to minimize the amount of liquid metal on the electrode and thus to obtain the highest possible electrode circumferential velocity. The amount of debris produced by discharge is minimized, too.

Further reduction of the amount of liquid metal on the electrode can be achieved by intermittently delivering the liquid metal forming separate regions or "islands" on the electrode surface, using for example a droplet generator in or as injection unit 26. An optical detection method might be applied to target the triggering energy beam 5 on liquid metal island.

For use with liquid metals which are solid at normal room temperature, for example tin, additional heating elements can be integrated in or applied to the cover 8 and the liquid metal cooling circuit (units 9 and 10 and connecting tubes) to allow for melting of the liquid tin in the cover 8 and the cooling circuit. By this means proper operating conditions can be reached after a system still-stand.

For low power operation, the wheel cover 8 can also be directly cooled with for example oil or another liquid metal by heat conduction or integrated cooling channels which use, for example, oil or another liquid metal.

While the invention has been illustrated and described in detail in the drawings in forgoing description, such illustration and description are to be considered illustrative or exemplary and not restrictive, the invention is not limited to the disclosed embodiments. The different embodiments described above and in the claims can also be combined. Other variations to the disclosed embodiments can be understood and effected by those skilled in the art in practicing the claimed invention, from a study of the drawings, the disclosure and the appended claims. For example, it is also possible to arrange the electrode wheels at a different angle as that shown in FIGS. 1 and 3. Furthermore, the construction of the electrode wheel cover may be geometrically different to that shown in the Figures as long as the described function of the cooling channel and the gap or wiper unit in extension of the cooling channel are maintained. Passages of the description which do not refer to the first or second mode of operation may be applied to both modes.

In the claims, the word "comprising" does not exclude other elements or steps, and the indefinite article "a" or "an" does not exclude a plurality. The mere fact that measures are recited in mutually different dependent claims does not indicate that a combination of these measures can not be used to advantage. The reference signs in the claims should not be construed as limiting the scope of these claims.

LIST OF REFERENCE SIGNS

1 electrode device
2 electrode device
3 capacitor bank
4 power supply
5 energy beam
6 discharge location
7 rotating electrode wheel
8 wheel cover
9 liquid metal pump
10 cooling device
11 cover entrance
12 cooling channel
13 liquid metal inlet
14 liquid metal outlet
15 pre-wiper
16 covered part
17 final wiper
18 overflow channel
19 uncovered part
20 discharge location
21 central region
22 rotational axis
23 gap
24 outer circumferential surface
25 side surfaces
26 liquid metal injection unit
27 wiper
28 liquid metal covered part
29 liquid metal beading
30 uncovered part

The invention claimed is:

1. An electrode device for gas discharge sources at least comprising:

an electrode wheel rotatable in a rotational direction around a rotational axis, said electrode wheel having an outer circumferential surface between two side surfaces, and an electrode wheel cover covering a portion of said outer circumferential surface and said side surfaces, said cover being configured to form a cooling channel in a circumferential direction between said cover, said outer circumferential surface and a radially outer part of said side surfaces, said cooling channel comprising an inlet and an outlet opening in said cover allowing a flow of liquid material through the cooling channel for cooling the electrode wheel by the liquid material, and either to form a gap between said cover and said outer circumferential surface in extension of said cooling channel in the circumferential direction, said gap having a smaller flow cross section than said cooling channel and limiting a thickness of a film of said liquid material formed on said outer circumferential surface during rotation of the electrode wheel or to inhibit the formation of such a film in extension of said cooling channel in the circumferential direction from the liquid material flowing through the cooling channel.

2. The device according to claim 1, wherein said electrode wheel cover comprises at least one wiper unit for inhibiting the formation of said film or to minimize the thickness of said film.

3. The device according to claim 1, further comprising a liquid material application unit arranged to apply liquid material on said outer circumferential surface between said cover and a location of gas discharge generation.

4. The device according to claim 3, wherein said liquid material application unit is designed to apply the liquid material such that a thin beading of said material forming on said outer circumferential surface does not cover the full width of said surface.

5. The device according to claim 1, wherein said outlet opening is connected via a feed line and a cooling device to said inlet opening to form a cooling circuit, said cooling device being configured to cool said liquid material supplied to said inlet opening of the cover.

6. The device according to claim 5, wherein a pump is arranged in said cooling circuit for circulating said liquid material in the cooling circuit.

7. The device according to claim 5, wherein said cooling circuit provides a flow of said liquid material in the rotational direction of the electrode wheel through said cooling channel.

8. The device according to claim 1, wherein said inlet and outlet openings extend essentially tangentially to the circumferential surface of the electrode wheel.

9. The device according to claim 1, wherein said cover extends over a main circumferential portion of the electrode wheel.

10. The device according to claim 1, wherein a wiper unit is arranged at an open end of said gap, said wiper unit being designed to further limit the thickness of the liquid material film on said outer circumferential surface during rotation of said electrode wheel.

11. The device according to claim 10, wherein said wiper unit is designed to strip off liquid material at portions of said side surfaces adjacent to the circumferential surface during rotation of said electrode wheel.

12. The device according to claim 10, wherein an overflow channel is formed at said open end of the gap to drain excess liquid material.

13. The device according to claim 1, wherein a wiper unit is arranged between said cooling channel and said gap, said wiper unit being designed to limit the thickness of the liquid material film on said outer circumferential surface and to strip off liquid material from said side surfaces during rotation of the electrode wheel.

14. The device according to claim 1, wherein at least a portion of said cover is electrically conductive allowing a supply of an electrical current via said cover and the liquid material to the electrode wheel.

15. A gas discharge source comprising an electrode device according to claim 1, said electrode device forming at least a first of two electrodes of said gas discharge source, which are arranged to have a smallest distance at a discharge region.

* * * * *